US010619392B2

(12) United States Patent
Hyunh

(10) Patent No.: US 10,619,392 B2
(45) Date of Patent: Apr. 14, 2020

(54) RAIL-MOUNTED DOORS

(71) Applicant: 1925Workbench Ltd., Etobicoke (CA)

(72) Inventor: Ngoc L. Hyunh, Toronto (CA)

(73) Assignee: 1925Workbench LTD., Etobicoke, Ontario (CA)

( * ) Notice: Subject to any disclaimer, the term of this patent is extended or adjusted under 35 U.S.C. 154(b) by 244 days.

(21) Appl. No.: 15/486,767

(22) Filed: Apr. 13, 2017

(65) Prior Publication Data

US 2017/0298670 A1 Oct. 19, 2017

Related U.S. Application Data

(60) Provisional application No. 62/322,034, filed on Apr. 13, 2016.

(51) Int. Cl.
*E05D 15/06* (2006.01)

(52) U.S. Cl.
CPC ..... *E05D 15/063* (2013.01); *E05Y 2900/132* (2013.01)

(58) Field of Classification Search
CPC ..... E05D 15/063; E05D 15/0652; E05D 15/0626; E05D 15/0643; E05Y 2900/132; E05Y 2201/684
USPC ..... 49/425, 426, 427, 409, 61, 63
See application file for complete search history.

(56) References Cited

U.S. PATENT DOCUMENTS 1,570,762 A * 1/1926 McTigue ..... E05D 15/063 16/96 R
2,754,535 A * 7/1956 Plemeng ..... E05D 15/063 16/87 R
2,815,543 A * 12/1957 Gates ..... E05D 15/0656 16/95 R
2,843,872 A * 7/1958 Hannon ..... E05D 15/0634 16/105
3,261,129 A * 7/1966 Robert ..... E05D 15/0626 49/411
3,296,744 A * 1/1967 Hentzi ..... E05D 15/0652 16/94 R
3,384,998 A * 5/1968 Abramson ..... A47K 3/34 16/90

(Continued)

FOREIGN PATENT DOCUMENTS

JP 02229381 A * 9/1990 ..... E05B 65/08
JP 08208159 A * 8/1996 ..... B66B 13/08

*Primary Examiner* — Brent W Herring
(74) *Attorney, Agent, or Firm* — Matthew Powell; Dickinson Wright PLLC

(57) ABSTRACT

A rail-mounted door system includes at least two door panels, a rail comprising means for attachment to a rail support, and at least four hanger assemblies. Each hanger assembly includes an upper portion provided with means for rotatable attachment to the at least one wheel, a lower portion provided with means for attachment to one of the at least two door panels, and at least one wheel adapted for positive, rotating engagement of the rail. The at least two door panels are supported by respective sets of at least two door hanger assemblies offset from each other in respective slide planes that permit substantially free and unimpeded movement of the least two door panels along a single track. In some cases, the upper portion of each door hanger in at least some door hanger assemblies is attached to the lower portion by an offset portion.

8 Claims, 4 Drawing Sheets

(56) References Cited

U.S. PATENT DOCUMENTS 3,426,480 A * 2/1969 Dzamba ..... B66B 13/301 187/333
3,611,637 A * 10/1971 Saino ..... E05D 15/1021 16/90
4,288,887 A * 9/1981 Johnson ..... E05D 15/063 16/105
4,355,486 A * 10/1982 Sherwood ..... E05D 15/063 49/409
4,769,949 A * 9/1988 Glendowne ..... A47K 3/34 16/90
5,165,142 A * 11/1992 Pilsbury ..... B66B 13/301 16/90
5,678,660 A * 10/1997 Karner ..... B66B 13/08 187/333
9,091,106 B2 * 7/2015 Allen ..... E05D 15/0652
9,549,643 B2 * 1/2017 Hayes ..... A47K 3/34
10,070,757 B2 * 9/2018 Jacob ..... A47K 3/34
2006/0207184 A1 * 9/2006 Whitaker ..... A47K 3/34 49/409
2007/0101540 A1 * 5/2007 Martin ..... A47K 3/34 16/97
2010/0242370 A1 9/2010 Trulaske, Sr.
2010/0313382 A1 * 12/2010 Andren ..... E05D 15/063 16/98
2012/0233926 A1 * 9/2012 Chang ..... E05D 15/063 49/358
2013/0042534 A1 * 2/2013 Polus ..... E05D 15/0673 49/425
2013/0111792 A1 5/2013 Attardo et al.
2014/0115968 A1 * 5/2014 Wei ..... E05D 13/00 49/352
2014/0250633 A1 * 9/2014 Allen ..... E05D 15/0652 16/96 R
2014/0311035 A1 * 10/2014 Gilliam ..... E05D 15/0652 49/410
2016/0010377 A1 1/2016 Lim
2016/0201373 A1 7/2016 Hoher
2016/0257198 A1 9/2016 Buttolo et al.
2016/0287027 A1 * 10/2016 Hayes ..... A47K 3/34
2016/0340951 A1 * 11/2016 Andren ..... E05D 15/063
2017/0027388 A1 * 2/2017 Schultz ..... E05D 15/0621
2017/0067276 A1 * 3/2017 Apodaca ..... E05D 15/0639
2017/0196412 A1 * 7/2017 Jacob ..... A47K 3/34
2017/0226786 A1 * 8/2017 Mayer ..... E05D 15/0643
2017/0298671 A1 * 10/2017 Wright ..... E05D 15/0652
2018/0148966 A1 * 5/2018 Sakabe ..... E05D 15/565
2018/0184853 A1 * 7/2018 Wei ..... E06B 3/4636
2019/0038084 A1 * 2/2019 Abrams ..... A47K 3/34

* cited by examiner

RAIL-MOUNTED DOORS

CROSS-REFERENCE TO RELATED APPLICATIONS

This application claims all right and benefit of U.S. provisional application Ser. No. 62/322,034, filed Apr. 13, 2016, the entire contents of which are herein incorporated by reference.

TECHNICAL FIELD

The present disclosure relates to doors and, more particularly, to improved rail or track-mounted doors for home, office, factory, barn, shed, and other interior or exterior use.

BACKGROUND

Configurations of track-mounted doors exist. However, they have typically required the use of a dedicated track for each individual panel that is mounted as part of the door structure. Thus, for example, two tracks have been utilized for a door structure comprising two door panels, which can be expensive and difficult to manufacture, install, operate, and maintain. Door configurations involving multiple tracks have also tended to be bulky and aesthetically challenging.

There is therefore a need for improvement in track-mounted doors.

SUMMARY

In various aspects, embodiments of the invention provide rail-mounted door systems and components thereof. In one aspect, a system in accordance with the invention comprises a single rail and at least four door hanger assemblies configured for supporting two or more door panels, each hanger assembly comprising a hanger configured for attachment to a door panel, and at least one wheel configured to engage the rail and roll thereon in order to facilitate movement of the door panel(s).

In another aspect, a rail in accordance with the invention comprises means for attachment to a rail support, the rail support adapted for attachment to a wall or other support surface or support structure in order to fix the rail in a stable position to allow the rail to support the door panel(s) for free rolling movement along the rail.

In still another aspect, a door hanger in accordance with the invention comprises an upper portion and a lower portion. In some embodiments, the upper portion comprises or engages with means for rotatable attachment of one or more wheels, while the lower portion comprises or engages with means for attachment to a door panel which is supported thereon. In some embodiments, at least two hangers may attach to and support a corresponding door panel. In some embodiments, the upper portion of a door hanger transitions to the lower portion by an offset portion that laterally spaces the lower portion of the door hanger apart from the upper portion. In this manner, the door panel attached to and supported on the lower portion is thereby also spaced by approximately the same distance. This configuration of a door hanger allows different door panels supported on the same rail to be spaced apart from each other by correspondingly different amounts depending on the lateral spacing imparted by the offset portion of each respective door hanger.

In still another aspects, rollable support of the door panels(s) upon the rail is implemented by adapting the wheels for positive, rotating engagement of the rail. For example, in some embodiments, wheels in accordance with the invention comprise flanges, so as to define channels generally in radial peripheral regions thereof, the channels thereby being configured to engage an upper edge of the rail and roll freely thereon. Alternatively, in some embodiments, the wheels may be configured to fit and roll freely within a channel or groove formed in the top of the rail.

By providing, in a system for mounting of two or more doors, multiple sets of door hanger assemblies in accordance with the disclosure, a plurality of door panels can be mounted onto a single rail where adjacent door panel(s) are laterally spaced apart from each other in non-interfering slide planes, thereby providing such panel(s) with sufficient clearance to roll wholly or partially past one other, without making contact with or substantially impeding each other's travel along significant portions of the rail.

In some embodiments, non-interference between adjacent door panel(s) is accomplished by providing each of a first set of hangers with lower portions offset from their upper portions in a first direction defined with reference to the rail support, e.g., "away" from the wheel support when the wheel of the hanger is rotatably engaged with the rail. In addition, each of a second set of hanger assemblies may be provided with lower portions offset from their upper portions in a second direction that is generally opposite to the first direction, e.g., toward the rail support when the wheel of the hanger is rotatably engaged with the rail. The offset portions of the first and second sets of hangers being oriented in generally opposite directions to one another, the total cumulative distance between the offset lower portions of the first and second sets is additive and may be configured to be sufficient to enable door panel(s) supported on such hanger assembles to clear one another when rolled along the single rail.

In some embodiments, non-interference between adjacent door panel(s) is accomplished alternatively by providing each of a first set of hangers without offset portions such that the upper portions of the hangers may transition directly into the lower portions without appreciable lateral deviation. In such cases, each of a second set of hanger assemblies may be provided with lower portions offset from their upper portions in a direction defined with reference to the rail support, which direction can be either "toward" or "away" from the wheel support when the wheel of the hanger is rotatably engaged with the rail. With the first set of hangers proving no or effectively no lateral offset of door panel(s) supported thereon, the second set of hangers may be provided with offset portions that by themselves provide sufficient lateral spacing so as to enable door panel(s) supported on a single rail to clear one another when rolled.

In some embodiments, a rail-mounted door system may comprise two door panels mounted onto a single rail using at least four door hanger assemblies. In such cases, each such door panel may be positioned in a respective slide plane that provides sufficient clearance for the other such door panel when rolled along the rail. However, in some embodiments, a rail-mounted door system may comprise three or more door panels mounted onto a single rail using at least six door hanger assemblies. In such cases, each such door panel may be positioned in a corresponding slide plane that provides sufficient clearance for each one or more adjacent door panel when rolled along the rail, although it may be the case that non-adjacent door panel(s) are positioned in the same or effectively same slide plane.

However, in some embodiments, a rail-mounted door system may comprise three or more door panels mounted onto a single rail using at least six door hanger assemblies, but where adjacent door panels are positioned in the same slide plane as opposed to different slide planes. For example, in some embodiments, a rail-mounted door system may comprise four door panels mounted onto a single rail using at least eight door hanger assemblies. In such cases, the middle adjacent pair of door panels may each by positioned in the same slide plane, while the two door panels on either side of the middle adjacent pair may each be positioned in a second slide plane that provides sufficient clearance for door panels in the middle adjacent pair.

Further features that may be incorporated in door systems in accordance with the invention include door guides and, optionally, wheel or door stops. In some cases, the door guides may be configured to engage the sides of the door panel(s) or otherwise engage the door panel(s) so as to prevent or other alleviate lateral swinging thereof on the rail. In some cases, the wheel or door stops may be adapted to prevent door panel(s) from rolling off the end of the rail.

BRIEF DESCRIPTION OF THE DRAWINGS

Various aspects and embodiments of the invention are illustrated in the accompanying drawings, which are meant to be exemplary and not limiting, and in which like references are intended to refer to like or corresponding parts.

DETAILED DESCRIPTION

Figure 1:
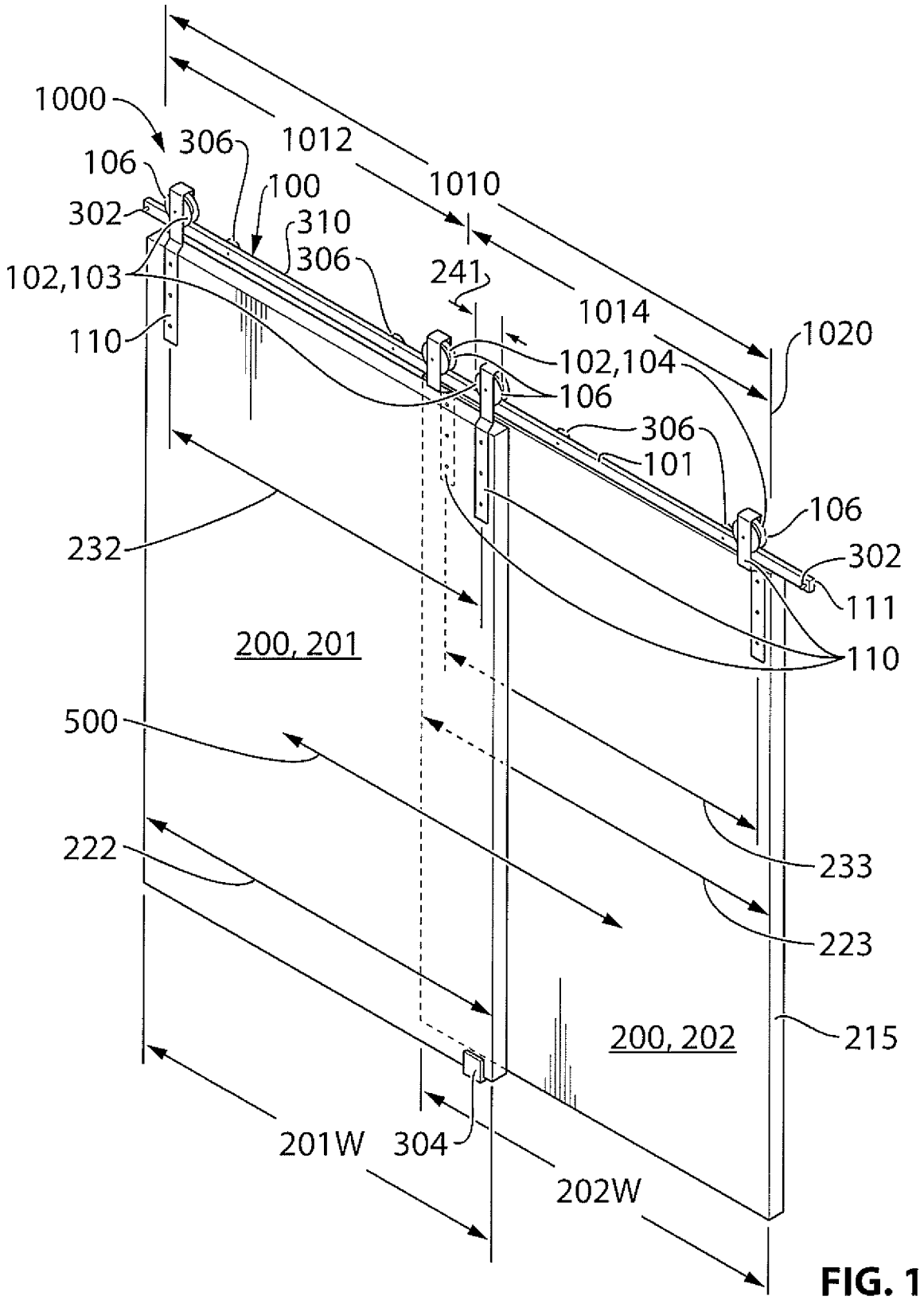
FIG. 1 is a perspective diagram showing an embodiment of a rail-mounted door assembly in accordance with aspects of the invention.

Referring initially to FIG. 1, there is shown a perspective diagram of a rail-mounted door system 1000 in accordance with the invention. In the example embodiment shown, system 1000 comprises a rail assembly 100, at least four hanger assemblies 110, two door panels 200, and accessories, including guide 304. However, as described further herein, alternative configurations of a rail-mounted door system 1000 in accordance with the invention may comprise greater numbers of door panels 200 and hanger assemblies 110.

Rail assembly 100 comprises, in the embodiment shown, a rail 101, stops 302, and rail supports 306. Rail 100 is attached to a support 400, which could be a wall or door frame of a house or other structure for example (see FIG. 3), by supports 306 in such fashion that an upper edge or surface 111 of the rail is clear for engagement of wheels or rollers 106. With this configuration, wheels or rollers 106 are thereby free to roll along the entire span of the upper edge 111 or at least substantial portions thereof. Wheels or rollers 106 are rotatably mounted within hanger assemblies 110, which are in turn attached to door panels 201, 202. By supporting wheels or rollers 106, rail 100 thereby may support the weight of door panels 200 and allows them to be moved back and forth, relative to the rail 100 and each other, in the directions of arrows 500.

Figure 2:
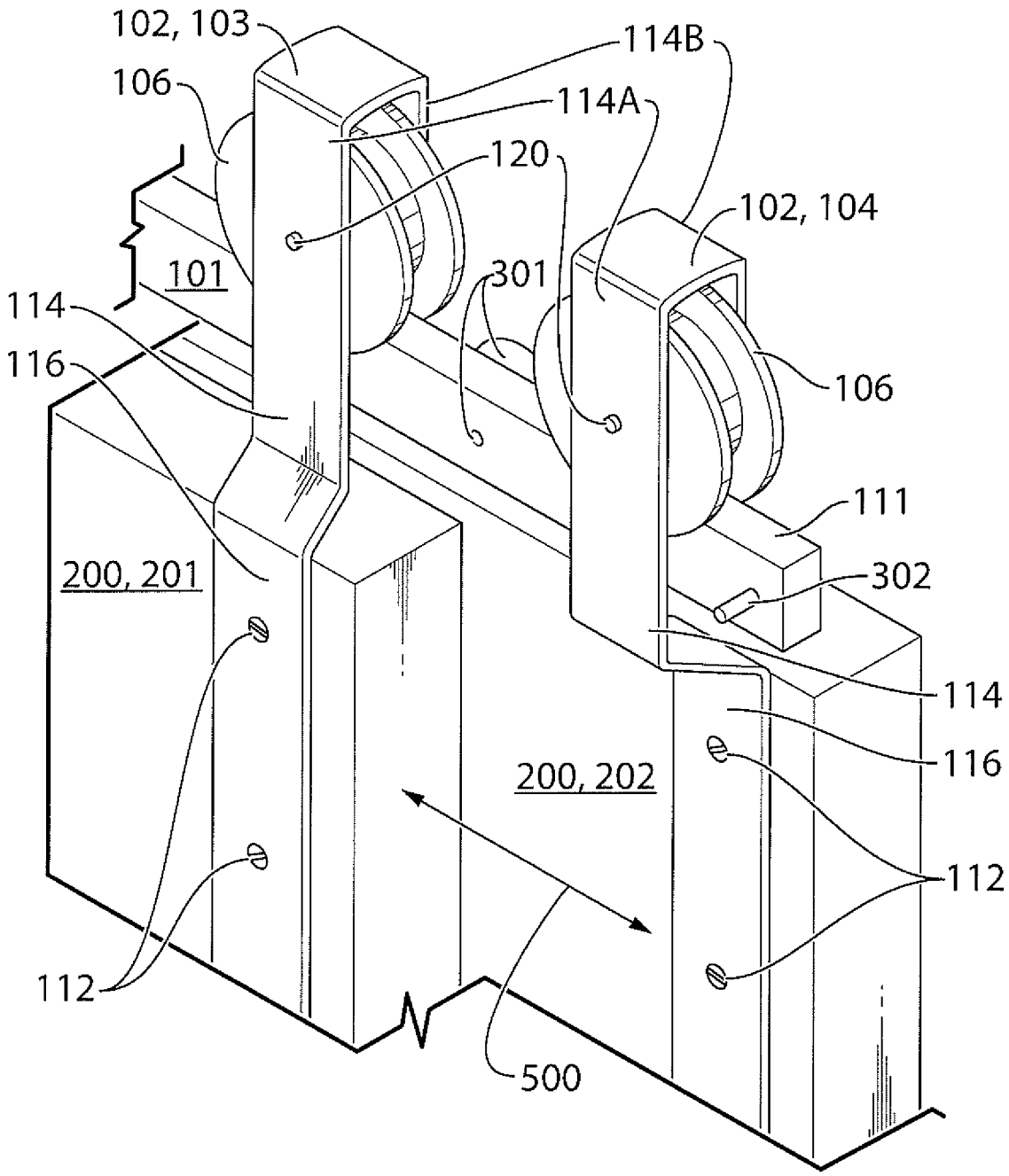
FIG. 2 is a perspective diagram showing embodiments of a door hanger assembly in accordance with aspects of the invention.

Referring now to FIG. 2, in some embodiments, each hanger assembly 110 comprises a hanger 102, a wheel or roller 106, and screw(s) or other means 112 for attachment of the hanger 102 to a door panel 200. Each hanger 102 comprises at least an upper portion 114 and a lower portion 116. Each upper portion 114 comprises a pair of flanges 114A, 114B forming a wheel housing 118, and wheels or rollers 106 are rotatably attached to upper portions 114 for example by means of spindles or axels 120 supported by the flanges 114A, 114B.

As shown, in some embodiments, the upper portion 114 transitions to the corresponding lower portion 116 by an offset portion 115. The offset portion 115 may be bent or otherwise shaped or configured, for example as in FIGS. 1 and 2, so as to allow a plurality of door panels 200, 201, 202 mounted on a single rail 101 to roll freely past portions of one another when rolled along the rail. However, as described further herein, in some embodiments, offset portion 115 may be eliminated in some but not necessarily other configurations of a hanger 102.

Figure 3:
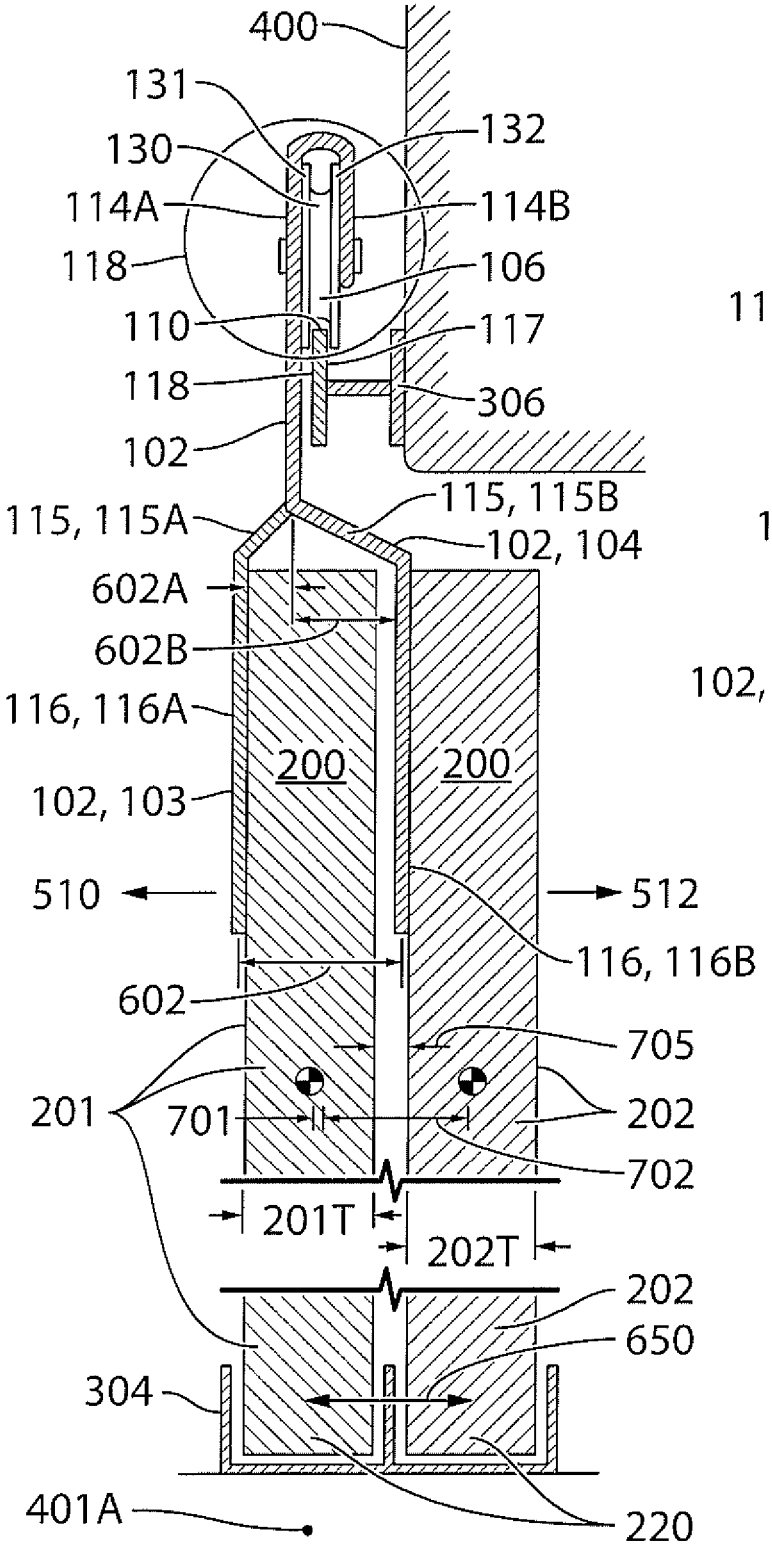
FIG. 3 is a cross-sectional diagram showing an embodiment of a rail-mounted door assembly in accordance with aspects of the invention.

Referring now to FIG. 3, in some embodiments, each of a first set 103 of hangers 103 are provided with lower portions 116A that are offset from corresponding upper portions 114 in a direction 510 away from the rail support 400 (e.g., a wall or door frame) when the wheel or roller 106 of the hanger 102 is rotatably engaged with the rail 101. Further, each of a second set 104 of hangers 102 are provided with lower portions 116B offset from corresponding upper portions 114 in an opposite direction 512, e.g., toward the rail support 400. While the terms "away" and "toward" are used herein to describe the particular orientations of lower portions 116A, 116B, such terms are used in a relative sense only for convenience and do not denote any absolute direction or orientation.

The total cumulative offset 602 between the respective lower portions 116A, 116B of the first and second sets 103, 104, which aggregate together due to their generally opposite orientations, provides sufficient clearance to enable the door panels 201, 202 to roll along the rail 101 without impeding one another. Thus, as described herein, multiple sets 103, 104 of hangers 102 can be configured, within a system 1000 for mounting of two or more doors 200, so as to enable mounting or hanging of pluralities of door panels 200 on a single railing 101, in such fashion that the doors are enabled to roll wholly or partially past one other, without interfering with each other's travel along significant portions of the rail.

In some embodiments, the lower portions 116A, 116B of both the first and second sets 103, 104 of hangers 102 are fastened to the same side of door panels 200. For example, in the configuration shown, the lower portions 116A, 116B of the first and second sets 103, 104 of hangers 102 are each fastened to the distal side of door panels 200, i.e., the "far" side, in relation to the rail support 400. However, in some cases, the attachment may alternatively be made in each case on the proximal, i.e., "near", side of the of door panels 200 (nor shown). Additionally, in some cases, the attachment may be made on opposite sides of the door panels 200 (not shown). That is, one of lower portions 116A, 116B may be fastened to a given side of the corresponding door panel 200, either proximal or distal, while the other of lower portions 116A, 116B may be fastened to the opposite side of the corresponding door panel 200.

Still referring to FIG. 3, in some embodiments, offset 602 may be the sum of offsets 602A and 602B of hangers 103, 104, respectively. Offsets 602A, 602B can be provided through any means consistent with the purposes disclosed herein. For example, offsets 602A, 602B can be formed through suitable deformation, such as bending, of a flat hanger template to form desired offset portions 115A, 115B.

Figure 4:
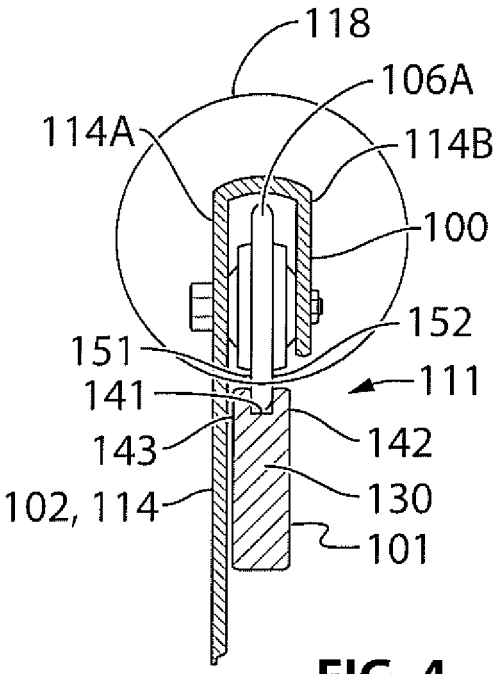
FIG. 4 is a partial cross-sectional diagrams showing an embodiment of a door hanger assembly engaged to a rail in accordance with aspects of the invention.

Likewise, wheel housing(s) 118 can be provided by any suitable means, including for example bending or otherwise forming a flat hanger template so that it comprises suitable flanges 114A, 114B as shown for example in FIGS. 3 and 4.

In some embodiments, offset portions 115 and/or housings 118 can be formed by a wide variety of other means, for example, including by ways of extrusion, forging, and/or assembly of sub-parts.

In some embodiments, the desired amount or length of offsets 602A, 602B, and cumulative offset 602, for a particular hanger assembly 100 can be determined based on one or more different considerations. Such considerations can for example include the weights, density, and/or dimensions of door panels 200, including widths 201T, 202T of door panels 200, 201, 202; the gauge or thickness of hangers 102; the weights of hangers 102, the offsets 701, 702 between rail(s) 101 and centers of gravity 291, 292 of door panels 200; and/or the desired gap(s) 702 between door panels 201, 202.

In some embodiments, different configurations of offsets 602A, 602B, 600, 701, 702, and gaps 702 can be enabled, or otherwise facilitated, through the use of appropriately-configured door guides 304. As shown in FIG. 3, for example, door guides 304 may be secured to a floor or other structure 401A, and configured to provide lateral support (in the direction of arrows 650) to the lower portions or edges 220 or other desired portions of door panels 201, 202. While door guides 304 may in some cases be omitted from a rail-mounted door system 100, depending on the particular configuration of door panels 200, e.g., size and shape, use of door guides 304 may be useful to prove additional lateral stability for door panels 200 to facilitate smooth movement thereof.

In some embodiments, as an alternative to door guides 304, other structures or mechanisms could be utilized to provide lateral support (in the direction of arrows 650) to door panels 200. For example, in some cases, one of the door panels 200 may, depending on the amount of offset, be relatively well stabilized on its own. Thus, a spacer or roller (e.g., bearing) could be fastened to the other of the door panels 200 and utilized to space them apart from each other. Alternatively, a strip or guide may be affixed to the ground in between door panels 200 and used to space them apart laterally. In some embodiments, these additional stability components may be utilized in conjunction with door guides 304.

Figure 5:
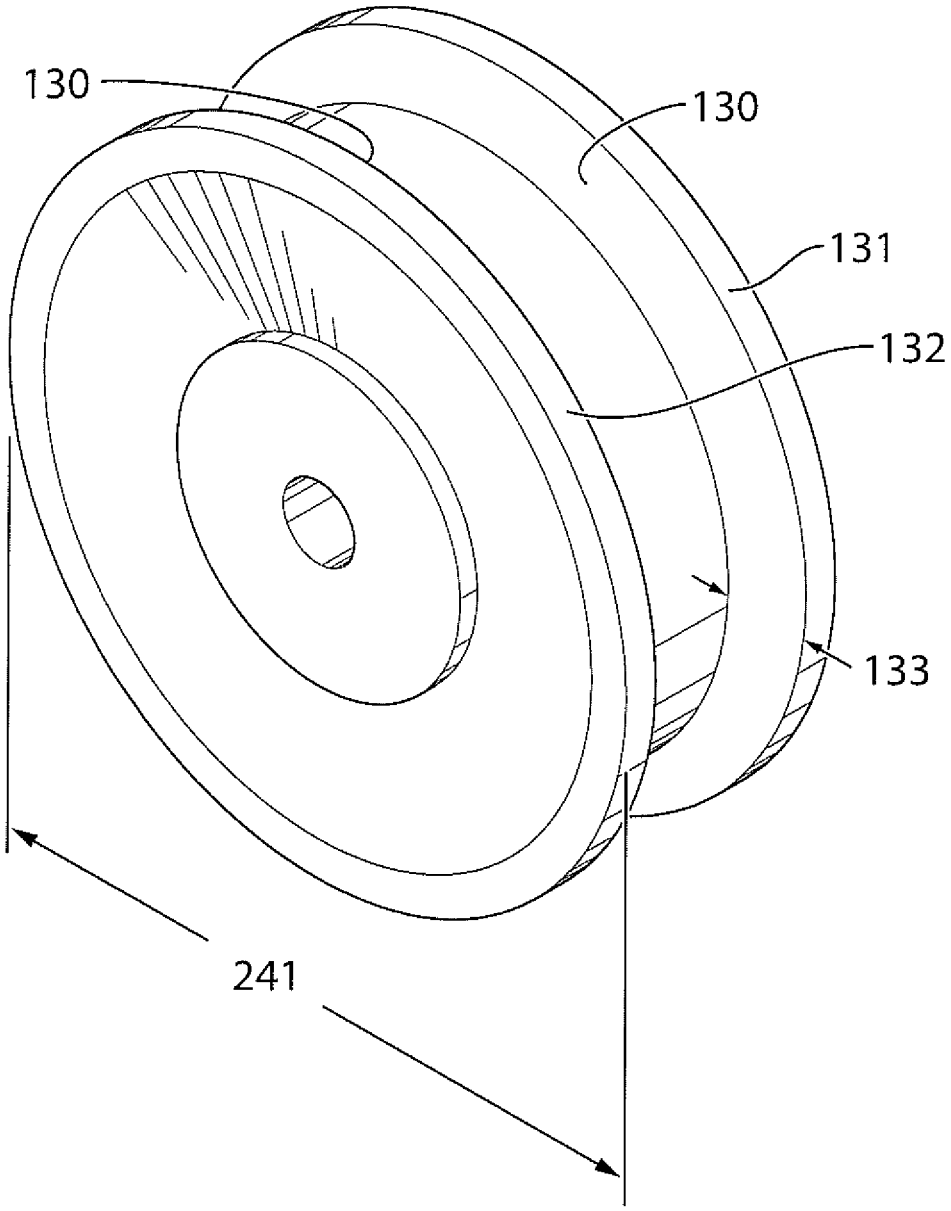
FIG. 5 is a perspective diagram showing an embodiment of a wheel or roller in accordance with aspects of the invention.

Secure rolling engagement of wheel(s) 106 by rails 101 can be accomplished by different suitable means. For example, as shown in FIG. 5, one or more wheels 106 can be formed with circumferential grooves or channels 130 configured to form flanges 131, 132, the flanges being sufficiently spaced by channel 130 and of sufficient depth 133 (due to the depth of channel 130) to securely engage the opposite surfaces 117, 118 of the rail 101. Alternatively, in some embodiments, as shown in FIG. 4, a channel 141 can be formed in the upper edge of rail 101, the channel 101 being of sufficient depth to form flanges 142, 143 that can securely engage opposite surfaces 151, 152 of the radial periphery of the wheel 106A.

In some embodiments, suitable dimensions for rails 101, wheels 106, hangers 102 (including upper, lower, and offset portions 114, 116, 115), and other components of assemblies and systems 1000 in accordance with the invention may be determined based on different considerations, including for example the dimensions of door panels 200, the dimensions of entrance-ways, doorways, closets, or other architectural features to be covered by door panels 200, etc., and the materials with which such components are fabricated.

For example, in the case of an entrance or space having a width 1010 intended to be covered by an assembly 1000 such as that shown in FIG. 1, rolling the door panels 200 to the left to the maximum distance permitted will collapse the doors into a minimum overlapped width 1012, and result in a maximum width 1014 of a passage between edge 215 of door panel 202 and reference 1020. The dimensions of widths 1010, 1012, 1014 will depend upon the widths 222, 223 of the door panels, the spacings 232, 233 between sets 102, 103 of hanger assemblies 110, and the diameters 241 of wheels 106. In general, the positioning of door hanger assemblies 110 may affect the amount by which each door panel 200 may roll along the rail 101 before abutting up against each other. However, by locating door hanger assemblies 110 proximate to the ends of door panels 200, it is possible in this arrangement for door panels 200 to be rollable along substantial portions of rail 101. Additionally, reducing the size of door hanger assemblies 110, if feasible given the weight of door panels 200, etc., may permit a wider range of motion of door panels 200 along the rail 101.

In a non-limiting exemplary configuration of system 1000 for use in a home, office, or other space to be occupied or frequented by humans, using doors of sufficient density and dimensions for such use, the following set of dimensions (all figures approximate) may in some cases be utilized:

- Width of door opening (1010)=48 inches
- Width of doors (201*w*, 202*w*)=32 inches each
- Wheel diameter (241)=2-3 inches, preferably about 2.5 inches, or about 6.5-9% of the door width
- Bracket spacings (232, 233)=within 1-2 inches of door edges
- Door thicknesses 201T, 202T=1.0-1.25 inches
- Offset 602A=¼ inch less than Offset 602B
- Offset 701=0.25 inches
- Offset 702=1.25 inches In some embodiments, offsets 602A, 602B can be in any desired relative relationship, depending upon the intended application of the system 1000. For example, 602A can be greater than, less than, or equal to offset 602B. In some cases, one of offsets 602A, 602B can be zero or effectively zero, in which case the other of offsets 602A, 602B may provide the entire cumulative offset for a given door panel 200. For example, as shown, in some cases offsets 602A may be zero implying that a door hanger 102 may include including an upper portion 114 and a lower portion 116, but no offset portion 115 therebetween. In order to accomplish the objectives described herein, and more particularly in association with the exemplary dimensions described herein, in some embodiments, offset 602A is approximately ¼ inch less than offset 602B.

In some embodiments, the various parts and components of systems 1000 in accordance with the invention may be made of any desirable or otherwise appropriate materials, including without limitation steel and other metals, polyvinyl chloride, styrene, and other plastics and, particularly in the case of door panels 200, wood and wood products.

In some embodiments, the number of door panels 200 included in a rail-mounted door system 1000 in accordance with the invention is greater than two and may include three or more door panels 200. For example, referring back to FIG. 1, in some cases, a rail-mounted door system 1000 may include four door panels 200 comprising two door panels 200 configured as shown therein, and two additional door panels 200 mounted adjacent thereto on the same rail, but configured in a "mirror image". Thus, in such an arrangement, of four side-by-side door panels on the rail, the middle two door panels 200 may be mounted using hanger assemblies 100 to be in the same slide plane (e.g., a slide plane that is further out from the rail support 400 or the "front" slide plane). Correspondingly, the remaining two panels 200 on either side of the middle pair may be mounted using hanger assemblies 100 to be each in a different slide plane from the middle pair (e.g., a slide plane that is nearer to the rail support 400 or the "rear" slide plane). In this manner, each of the door panels 200 may be provided with clearance to roll along a rail 101 free of and unimpeded by at least one adjacent door panel 200, although not necessarily with respect to both adjacent door panels (in the case of the middle pair of door panels 200).

While an alternative embodiment comprising four door panels 200 has been described, other combinations and configurations comprising still other numbers of door panels, for example, six or eight door panels 200, is also possible. For example, the selected number of door panels 200 in a rail-mounted door system 1000 may depend on considerations including personal preference and/physical limitations, such as the dimensions of a door frame, closet, or wall support.

In addition, configurations of a rail-mounted door system 1000 may include those with door panels that are mounted to slide in more than two different slide planes. For example, a rail-mounted door system 1000 may include six different door panels 2000 that are mounted to slide in three corresponding slide planes along a single rail. In such case, a rail-mounted door system 1000 may comprise one pair of hangers 102 proving offset in one direction, a second pair of hangers providing offset in the opposite direction, and a third pair of hangers providing effectively no offset, each as described herein.

While the disclosure has been provided and illustrated in connection with specific, presently-preferred embodiments, many variations and modifications may be made without departing from the spirit and scope of the invention(s) disclosed herein. The disclosure and invention(s) are therefore not to be limited to the exact components or details of methodology or construction set forth above. Except to the extent necessary or inherent in the processes themselves, no particular order to steps or stages of methods or processes described in this disclosure, including the Figures, is intended or implied. In many cases the order of process steps may be varied without changing the purpose, effect, or import of the methods described. The scope of the invention is to be defined solely by the appended claims, giving due consideration to the doctrine of equivalents and related doctrines.

The invention claimed is:

1. A rail-mounted door system, comprising:

at least two door panels;

a rail configured for attachment to a rail support; and at least four hanger assemblies comprising a first set of at least two door hanger assemblies and a second set of at least two door hanger assemblies, each of the at least four hanger assemblies comprising an upper portion, a lower portion, an offset portion coupling the upper portion to the lower portion, and at least one wheel, wherein for each of the at least four hanger assemblies:

the upper portion comprising a wheel housing around a top of the at least one wheel, the wheel housing comprising a pair of wheel housing flanges each rotatably attached to and supporting the at least one wheel;

the lower portion is configured for attachment to one of the at least two door panels; and the at least one wheel is adapted for positive, rotating engagement of the rail;

wherein the at least two door panels are supported by the first and second sets of at least two door hanger assemblies on the same rail, the corresponding offset portions of the door hanger assemblies in the first and second sets of door hanger assemblies cumulatively spacing the at least two door panels offset from each other in respective slide planes that permit substantially free and unimpeded movement of the at least two door panels relative to one another, and wherein the first and second sets of at least two door hanger assemblies are positioned with respect to one another so that each of the at least two door panels is movable along at least a portion of the same rail without abutting up against the other, while the upper portions of the at least four hanger assemblies remain in linear alignment with each other.

2. The system of claim 1, wherein with respect to the first set of hanger assemblies, the offset portion of each hanger assembly is configured such that the lower portion is offset from the upper portion in a direction away from the rail support when the wheel of the hanger is rotatably engaged with the rail; and with respect to the second set of hanger assemblies, the offset portion of each hanger assembly is configured such that the lower portion is offset from the upper portion in a direction toward from the rail support when the wheel of the hanger is rotatably engaged with the rail.

3. The system of claim 1, comprising at least one door guide, the door guide configured for attachment to a floor and comprising at least two flanges, the flanges configured to engage both sides of at least one door panel when the door panel is supported on the rail.

4. The system of claim 1, comprising at least one stop proximate each end of the rail.

5. The system of claim 1, comprising at least four door panels and at least eight door hanger assemblies.

6. The system of claim 5, wherein two of the door panels are supported in a first slide plane and two of the door panels are supported in a second slide plane offset from the first slide plane.

7. The system of claim 1, wherein the respective offset portions of the door hanger assemblies in the first and second sets of door hanger assemblies are unequal.

8. The system of claim 7, wherein the offset portion of the door hanger assemblies in the first set of door hanger assemblies is smaller than the offset portion of the door hanger assemblies in the second set of door hanger assemblies.

* * * * *